US007950788B2

(12) United States Patent
Therien et al.

(10) Patent No.: US 7,950,788 B2
(45) Date of Patent: May 31, 2011

(54) PRINTING DEVICE HAVING SUPPLY OF COLORANT AND RECEPTIVE TO PRINT CARTRIDGE HAVING SELF-CONTAINED SUPPLY OF COLORANT

(75) Inventors: Patrick Therien, Camas, WA (US); David Olsen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1075 days.

(21) Appl. No.: 11/738,322

(22) Filed: Apr. 20, 2007

(65) Prior Publication Data

US 2008/0259142 A1 Oct. 23, 2008

(51) Int. Cl.
*B41J 2/175* (2006.01)

(52) U.S. Cl. ..... 347/86; 347/21; 347/84; 347/85

(58) Field of Classification Search ..... 347/21, 347/84–86

See application file for complete search history.

(56) References Cited

U.S. PATENT DOCUMENTS

| | | | | |
|---|---|---|---|---|
| 5,369,429 | A | 11/1994 | Erickson | |
| 5,488,401 | A | 1/1996 | Mochizuki | |
| 5,971,529 | A * | 10/1999 | Pawlowski et al. | 347/86 |
| 6,953,239 | B2 * | 10/2005 | Gondek et al. | 347/43 |
| 2005/0212878 | A1 * | 9/2005 | Studer et al. | 347/86 |
| 2006/0007278 | A1 | 1/2006 | Holland | |

OTHER PUBLICATIONS

International Search Report for International Application No. PCT/US2008/060894, filing date Apr. 18, 2008.

* cited by examiner

*Primary Examiner* — Ryan Lepisto
*Assistant Examiner* — Guy G Anderson

(57) ABSTRACT

A printing device includes a supply of colorant and a mechanism. The mechanism is receptive to removable insertion of a first print cartridge and a second print cartridge. One of the first print cartridge and the second print cartridge can be inserted into the mechanism at any given time. The first print cartridge at least ultimately uses the supply of colorant of the printing device to form the images on the media. The second print cartridge has a self-contained supply of colorant that is exclusively used in lieu of the supply of colorant of the printing device to form the images on the media.

20 Claims, 6 Drawing Sheets

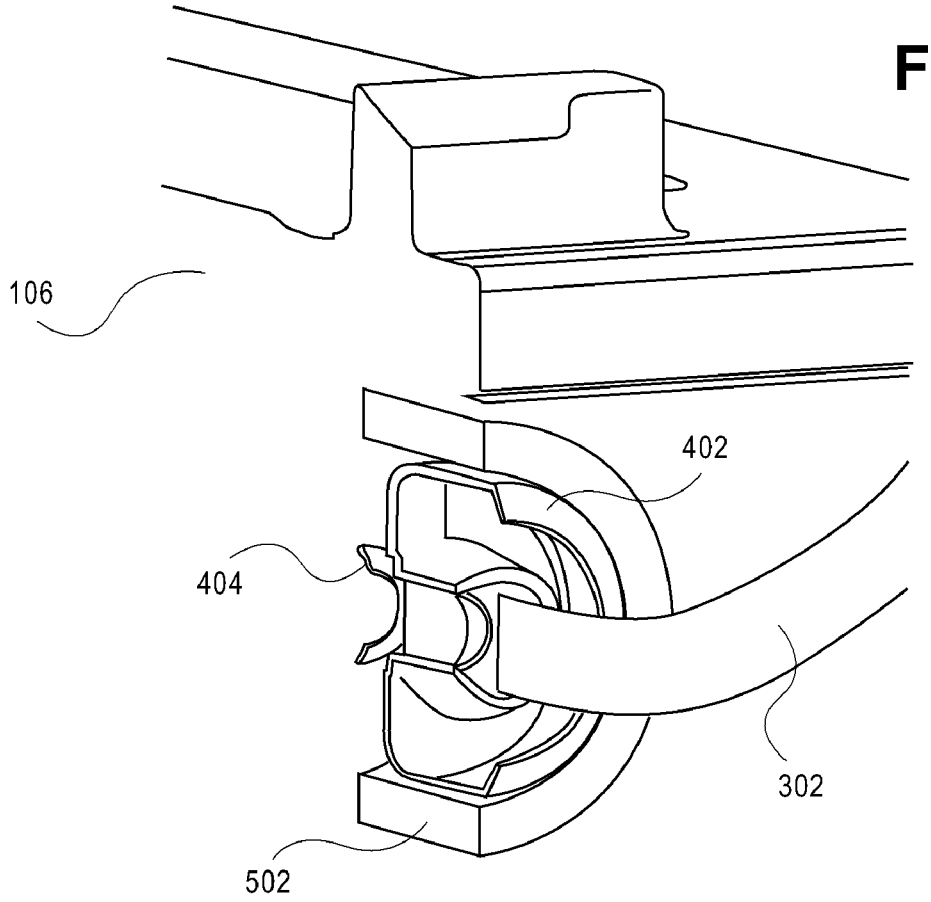
FIG. 5
FIG. 6
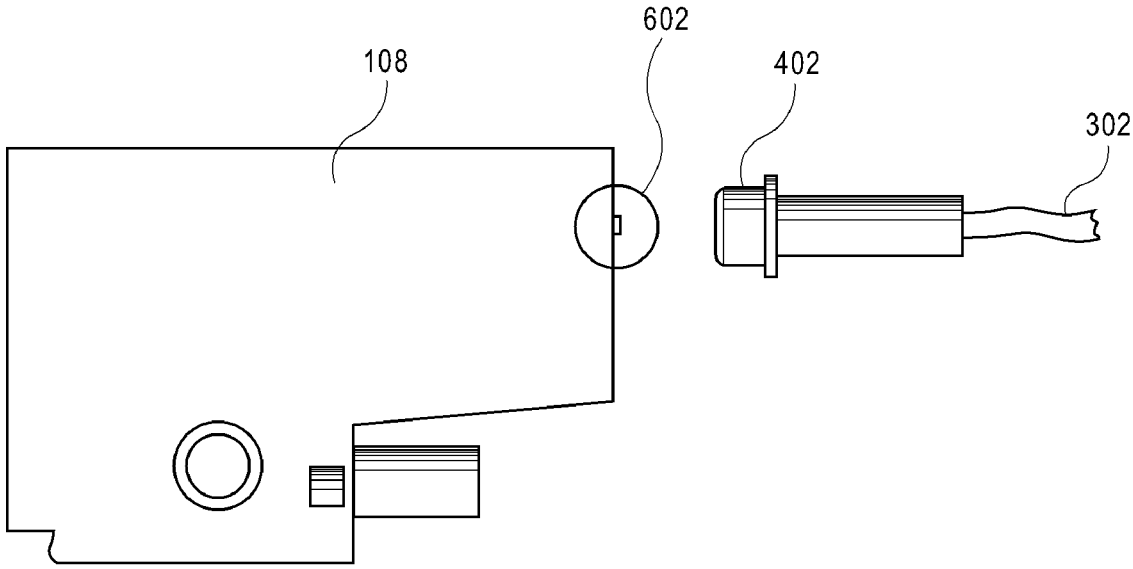

PRINTING DEVICE HAVING SUPPLY OF COLORANT AND RECEPTIVE TO PRINT CARTRIDGE HAVING SELF-CONTAINED SUPPLY OF COLORANT

RELATED PATENT APPLICATIONS

The present patent application is related to the co-filed patent application Ser. No. 11/738,370 entitled "Printing device having supply of colorant that is non-refillable and at least substantially non-removable from end user perspective"

BACKGROUND

Inkjet printing devices eject ink onto media to form images on the media. Traditionally, inkjet printing devices have had removably inserted print cartridges that contain the ink which is used to form images on media. A common complaint of users is that these print cartridges have to be replaced relatively frequently, and are susceptible to theft in multiple-user environments such as office environments and public places like libraries.

Therefore, more recently, inkjet printing devices have been constructed in which larger supplies of ink are disposed at least substantially permanently within the inkjet printing devices. The supply of ink within such an inkjet printing device may correspond to the predicted lifetime of the device. However, if the supply of ink is depleted before the end of life of the inkjet printing device, the device may need servicing or refurbishing by a qualified provider to install a new supply of ink, in that there may be no way for the user to refill the device with ink.

BRIEF DESCRIPTION OF THE DRAWINGS

FIG. 5 is a diagram depicting the fluidic coupling of FIG. 4 in more detail, according to an embodiment of the invention.

FIG. 6 is a diagram depicting how a print cartridge may not be fluidically coupled to an internal colorant supply of a printing device that is capable of fluidic coupling to a different type of print cartridge, according to an embodiment of the invention.

DETAILED DESCRIPTION OF THE DRAWINGS

Figure 1:
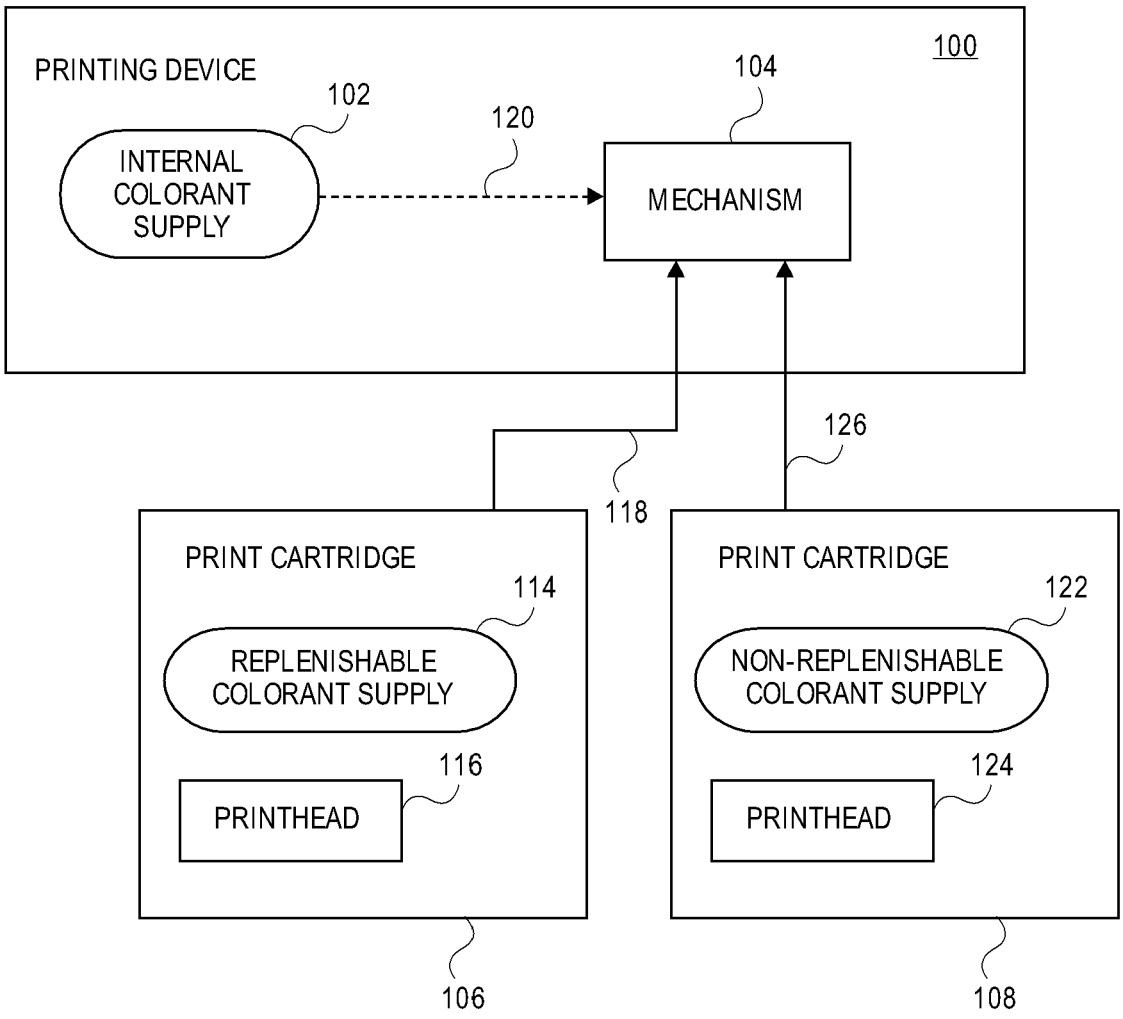
FIG. 1 is a block diagram of a printing device, according to an embodiment of the invention.

FIG. 1 shows a block diagram of a printing device 100, according to an embodiment of the invention. The printing device 100 is depicted in FIG. 1 as including an internal colorant supply 102 and a mechanism 104, which may be a carriage that moves across a sheet of media in a direction perpendicular to a direction in which the media sheet is advanced through the printing device 100, as can be appreciated by those of ordinary skill within the art. The mechanism 104 is receptive to removable insertion of both a print cartridge 106 and a print cartridge 108. As can also be appreciated by those of ordinary skill within the art, the printing device 100 typically includes other components besides those depicted in FIG. 1, such as the rollers, motors, and so on, that, for instance, advance sheets of media through the printing device 100.

The internal colorant supply 102 may be ink, such as a bag or a box of ink, such that the printing device 100 is an inkjet-printing device. The internal colorant supply 102 is external to the print cartridges 106 and 108 that are insertable into the printing device 100. While the printing device 100 is depicted as including one such colorant supply 102, there may be more than one supply of colorant. For example, for the printing device 100 to form full-color images on media, the device 100 may include a black colorant supply, a cyan colorant supply, a magenta colorant supply, and a yellow colorant supply. The colorant supply 102 is at least substantially permanently disposed within the printing device 100. That is, it may be attached to the printing device 100 during manufacture of the device 100, and not intended for replacement by the user. Furthermore, the colorant supply 102 can be non-refillable, in that once the colorant has been exhausted, it may not be practical or be able to be refilled by the user. The internal colorant supply 102 may have a sufficiently large volume of colorant so that the printing device 100 can form images using colorant from the colorant supply 102 for the projected life of the device 100.

As has been noted, the mechanism 104 may be a carriage, which may have one or more slots receptive to removable insertion of print cartridges, such as the print cartridges 106 and 108. The print cartridge 106 may include a replenishable colorant supply 114, such as ink, and/or a printhead 116. When the print cartridge 106 is inserted into the mechanism 104, as indicated by the arrow 118, the printing device 100 forms images on media by the printhead 116 initially using colorant from the replenishable colorant supply 114. As the colorant within the replenishable colorant supply 114 is used, however, the internal colorant supply 102 replenishes the colorant supply 114, via a fluidic connection between the internal colorant supply 102 and the print cartridge 106removably inserted within the mechanism 104, as indicated by the dotted arrow 120.

For instance, the printing device 100 may be shipped with and be sold to consumers as including the print cartridge 106. The print cartridge 106 is removably inserted into the mechanism 104 at the beginning of its life. As the colorant supply 114 within the print cartridge 106 is used, it is replenished by the internal colorant supply 102. Therefore, where the internal colorant supply 102 contains sufficient colorant for the projected life of the printing device 100, the print cartridge 106 will be able to be used to form images on media, and will not have to be replaced, for this period of time.

It is noted that in one embodiment, the print cartridge 106 may not include the replenishable colorant supply 114 or the printhead 116. Where the print cartridge 106 does not include the colorant supply 114, the internal colorant supply 102, via fluidic connection to the print cartridge 106 removably inserted into the mechanism 104, as indicated by the dotted arrow 120, immediately provides the colorant by which the printhead 116 forms images on media. Where the print cartridge 106 does not include the printhead 116, the printing device 100 may include a separate printhead, which may be removably or permanently attached within the device 100.

Thus, it can be said that the print cartridge 106 at least ultimately uses the internal colorant supply 102 of the printing device 100 to form images on media. Where the print cartridge 106 includes its own self-contained, but replenishable, colorant supply 114, images are formed on media using colorant from this colorant supply 114, but the colorant supply 114 is replenished with colorant from the colorant supply 102 of the printing device 100 as these images are formed. As such, the internal colorant supply 102 is indirectly and ultimately used to form images on media. By comparison, where the print cartridge 106 lacks its own self-contained colorant supply 114, images are formed on media using colorant supply 102 of the printing device 100 directly.

It is also noted that there may be more than one print cartridge 106. For example, there may be a black print cartridge, a cyan print cartridge, a yellow print cartridge, and a magenta print cartridge. Each such print cartridge 106 may include a correspondingly colored replenishable colorant supply 114, and a printhead 116. In another embodiment, there may be two print cartridges 106: a black print cartridge 106 having a black colorant supply 114, and a color print cartridge 106 having, for example, cyan, magenta, and yellow colorant supplies 114.

Once the internal colorant supply 102 of the printing device 100 has been exhausted due to formation of images on media, the replenishable colorant supply 114 of the print cartridge 106 is no longer able to be replenished with colorant from the internal colorant supply 102. Even though the internal colorant supply 102 may have contained a sufficient amount of colorant corresponding to the projected life of the printing device 100, the colorant supply 102 may have been exhausted prematurely due to, for instance, usage of the printing device 100 at a greater than anticipated rate. In other words, the printing device 100 may still be operable to form images on media, but for the lack of colorant within the internal colorant supply 102. The printing device 100 still being operable may also be desirable because if the colorant supply 102 was used unevenly, such that one or more colors of colorant have been exhausted but one or more other colors have not, the user may still be able to use the printing device 100 with the colors of colorant that have not been exhausted.

Therefore, at this time, the print cartridge 106 is removed from the mechanism 104 of the printing device 100, and the print cartridge 108 is removably inserted into the mechanism 104, as indicated by the arrow 126. The print cartridge 108 includes a non-replenishable colorant supply 122 and a printhead 124. Unlike the print cartridge 106, the print cartridge 108 is not fluidically connected to the internal colorant supply 102 upon insertion into the mechanism 104. As such, the print cartridge 106 is intended for usage when the internal colorant supply 102 has been exhausted. The printhead 124 of the print cartridge 108 uses colorant from its own, self-contained non-replenishable colorant supply 122 to form images on media, as is the case, for instance, with a conventional printing device like a conventional inkjet-printing device. The colorant supply 122 is non-replenishable in the sense that it is not able to be replenished from the internal colorant supply 102 of the printing device 100.

Thus, the print cartridge 108 may be a cartridge that is intended to be sold to consumers after the internal colorant supply 102 has been exhausted but where the printing device 100 is still functional but for this exhaustion of the internal colorant supply 102. The printing device 100, by having the mechanism 104 that is receptive to both the print cartridge 106 and the print cartridge 108, combines advantageous aspects of two different types of printing devices. Like printing devices that have internal colorant supplies intended to supply the printing devices with sufficient colorant throughout the intended lives of the devices, the printing device 100 includes such an internal colorant supply 102. Therefore, for an initially long period of time, the printing device 100 will not need periodic replacement of print cartridges.

However, like more conventional printing devices that are receptive to insertion of print cartridges having self-contained colorant supplies, the printing device 100 is receptive to insertion of the print cartridge 108 having a self-contained colorant supply 122. Therefore, unlike other types of printing devices that have internal colorant supplies, the printing device 100 is usable even when its colorant supply 102 is exhausted, since the print cartridge 108 can be inserted into the device 100 so that the device 100 can continue forming images on media after the internal colorant supply 102 has been exhausted. Users of the printing device 100 thus have several benefits: a printing device 100 that does not initially require periodic replacement of print cartridges to continue forming images on media, but that nevertheless is receptive to print cartridges having self-contained colorant supplies where the internal colorant supply 102 of the device 100 itself has been exhausted.

In one embodiment, the internal colorant supply 102 may be initially filled with the same amount of colorant regardless of the user. This amount of colorant may the amount that the manufacturer of the printing device 100 has determined is sufficient to last for a predetermined length of time based on predetermined usage characteristics. For instance, the amount of colorant may be sufficient to last 95% of users at least a number of years. In another embodiment, the internal colorant supply 102 may be initially filled with an amount of colorant as requested by the user. For example, when ordering the printing device 100, the user may request how much colorant he or she wishes to initially purchase, such that the colorant supply 102 that is provided is equal to this amount of colorant. The user may, for instance, indicate that he or she would like to purchase three years worth of colorant based on expected averaged usage of the printing device 100. In this way, the user may be able to purchase the amount of colorant he or she expects to use for a given length of time, based on expected usage of the printing device 100.

When the print cartridge 108 is inserted into the mechanism 104 of the printing device 100, images are formed on media using the self-contained colorant supply 122 of the print cartridge 108. Normally, usage of the print cartridge 108 is intended where the internal colorant supply 102 of the printing device 100 has already been exhausted. However, even where the internal colorant supply 102 has not been exhausted, when the print cartridge 108 is inserted into the printing device 100, colorant from the colorant supply 102 of the device 100 is not used to form images on media. Rather, in such instance, the colorant supply 122 of the print cartridge 108 is exclusively used to form images on media, in lieu of the internal colorant supply 102 of the printing device 100.

It is noted that in one embodiment, the print cartridge 106 may not include the printhead 124, where, for instance, the printing device 100 includes a separate printhead that is removably or permanently attached within the device 100. It is also noted that there may be more than one print cartridge 108, such as black, cyan, yellow, and magenta print cartridges including correspondingly colored colorant supplies. In another embodiment, there may be two print cartridges 108: a black print cartridge 108 having a black colorant supply 122, and a color print cartridge 108 having, for example, cyan, magenta, and yellow colorant supplies 122.

Figure 2:
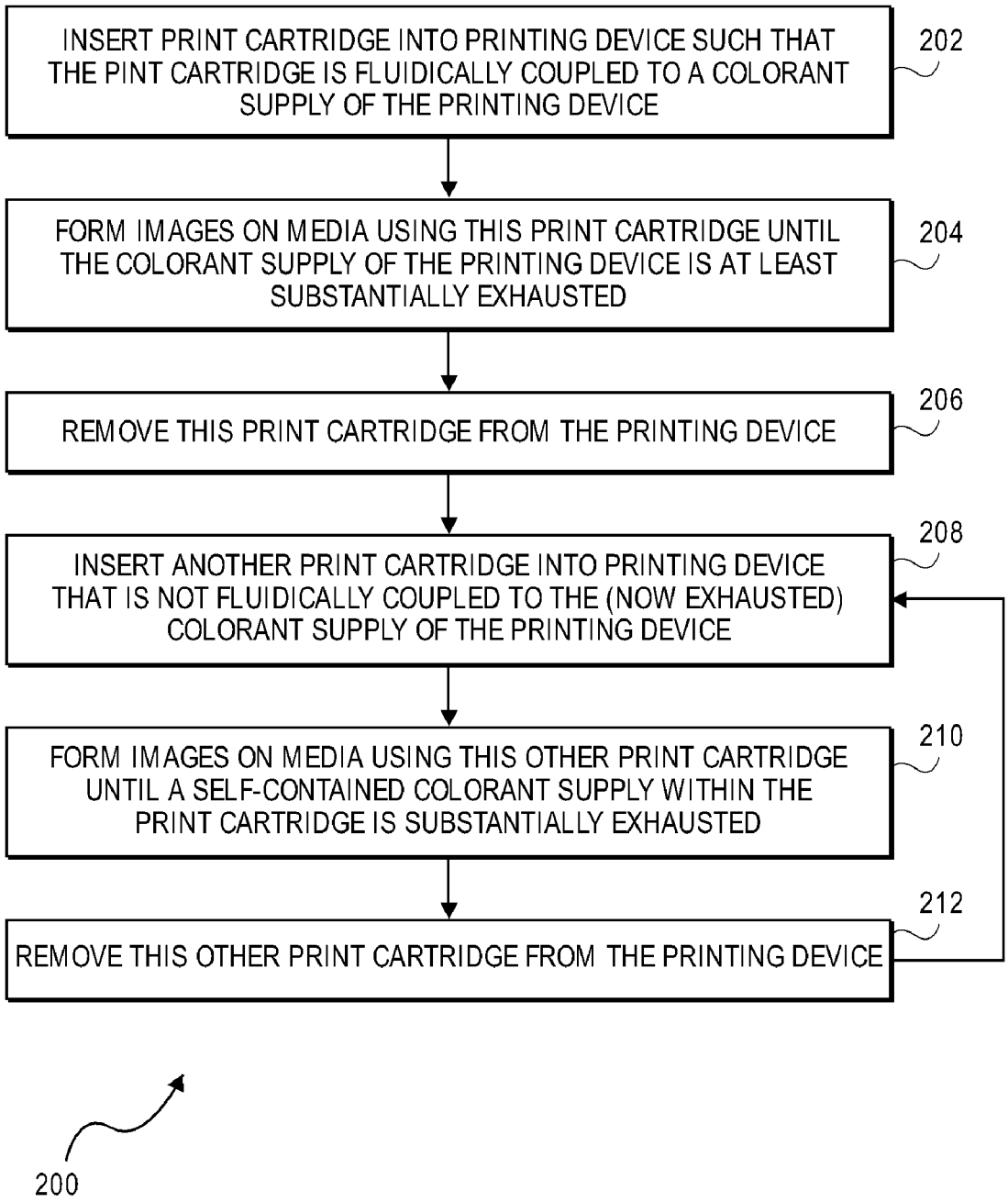
FIG. 2 is a flowchart of a method as to how the printing device of FIG. 1 can be used, according to an embodiment of the invention.

FIG. 2 shows a representative method 200 by which the printing device 100 can be used, according to an embodiment of the invention. The print cartridge 106 is inserted into the printing device 100 (202), such that the print cartridge 106 is fluidically connected, or coupled, to the internal colorant supply 102 of the printing device 100. Images are then formed on media as desired using the print cartridge 106, until the colorant supply 102 of the printing device 100 becomes at least substantially exhausted (204). As has been noted, the internal colorant supply 102 may last for a relatively long period of time, corresponding to, for instance, the projected life of the printing device 100. Thereafter, the print cartridge 106 is removed from the printing device 100 (206), and the print cartridge 108 is inserted into the printing device 100 (208).

The print cartridge 108, however, is not fluidically connected or coupled to the now-substantially exhausted internal colorant supply 102 of the printing device 100. Rather, images are formed on media using the print cartridge 108 via the self-contained colorant supply 122 of the print cartridge 108 (210), until this colorant supply 122 is itself at least substantially exhausted. The colorant supply 122 of the print cartridge 108 is typically smaller than the internal colorant supply 102 of the printing device 100, and may not last as long of a period of time as the colorant supply 102 of the device 100. Once the colorant supply 122 of the print cartridge 108 has been exhausted, the cartridge 108 is removed from the printing device 100 (212), and the method 200 may be repeated at part 208, where a new print cartridge 108 is inserted into the printing device 100.

Figure 3:
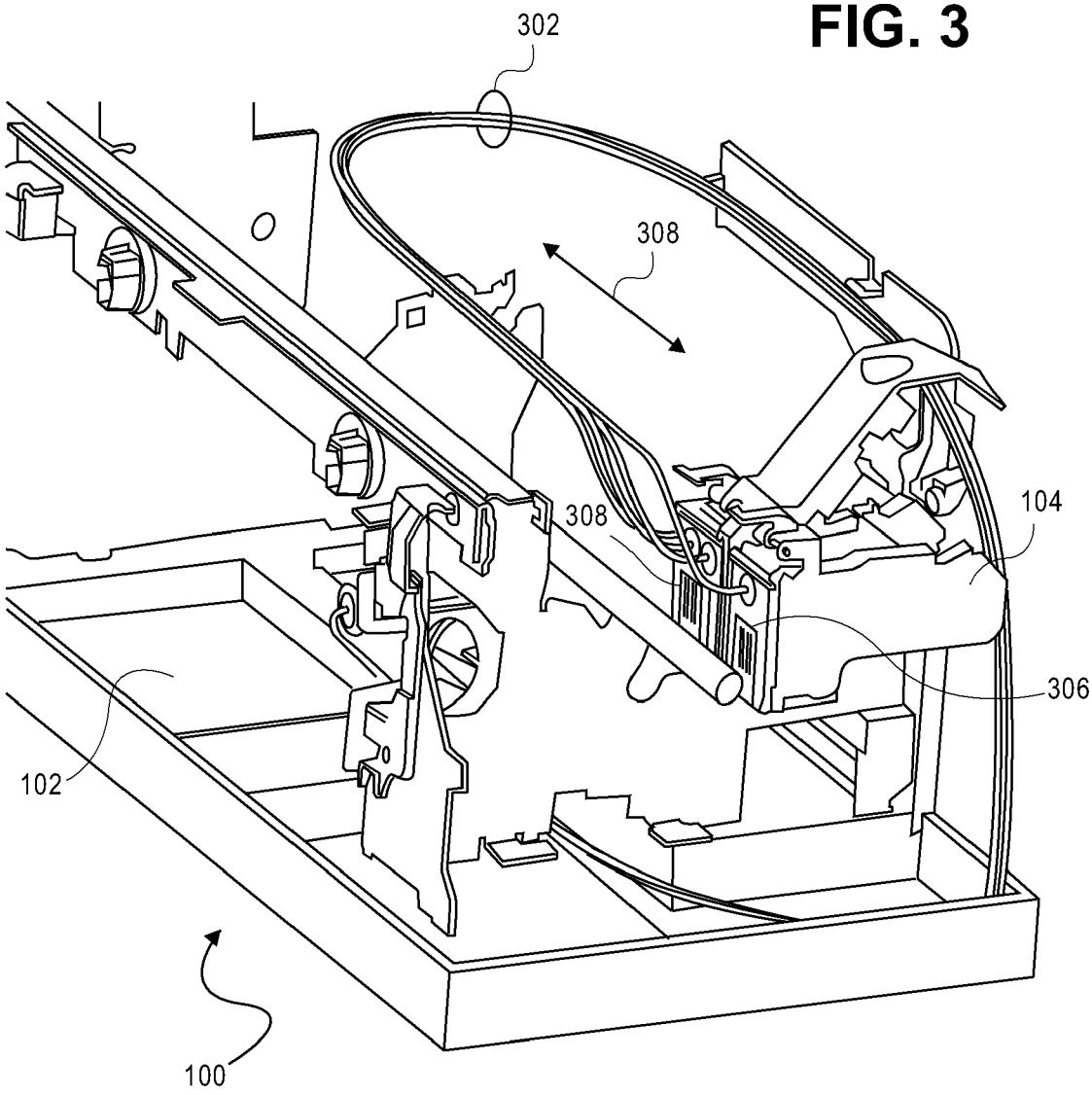
FIG. 3 is a diagram of a printing device in which an internal colorant supply can be fluidically coupled to a carriage, according to an embodiment of the invention.

FIG. 3 shows how internal colorant supplies 102 of the printing device 100 can be delivered to the mechanism 104 for potential fluidic connection to print cartridges 304 and 306, according to an embodiment of the invention. The internal colorant supplies 102 are particularly bags of ink, and may include bags of cyan, magenta, yellow, and black ink. The print cartridge 304 is a color print cartridge capable of ejecting cyan, magenta and yellow ink, whereas the print cartridge 306 is a black print cartridge capable of ejecting black ink. The print cartridges 304 are inserted within the mechanism 104, which is a carriage capable of moving in the directions indicated by the bidirectional arrow 308 back and forth across media. The body of the carriage is not depicted in FIG. 3 for illustrative clarity.

Tubing 302 delivers the ink from the internal colorant supplies 102 to the mechanism 104. It can be said, therefore, that the tubing 302 fluidically connects, or couples, the colorant supplies 102 to the mechanism 104. The tubing 302 includes individual tubes for each of the colors of ink. Thus, there may be four tubes: one for cyan ink, one for magenta ink, one for yellow ink, and one for black ink. In the case where the print cartridges 304 and 306 are instances of the print cartridge 106, the print cartridges 304 and 306 interface with the tubing 302 to become fluidically connected with the ink of the colorant supplies 102. By comparison, where the print cartridges 304 and 306 are instances of the print cartridge 108, the print cartridges 304 and 306 do not interface with the tubing 302 to become fluidically connected with the ink of the colorant supplies 102.

Figure 4:
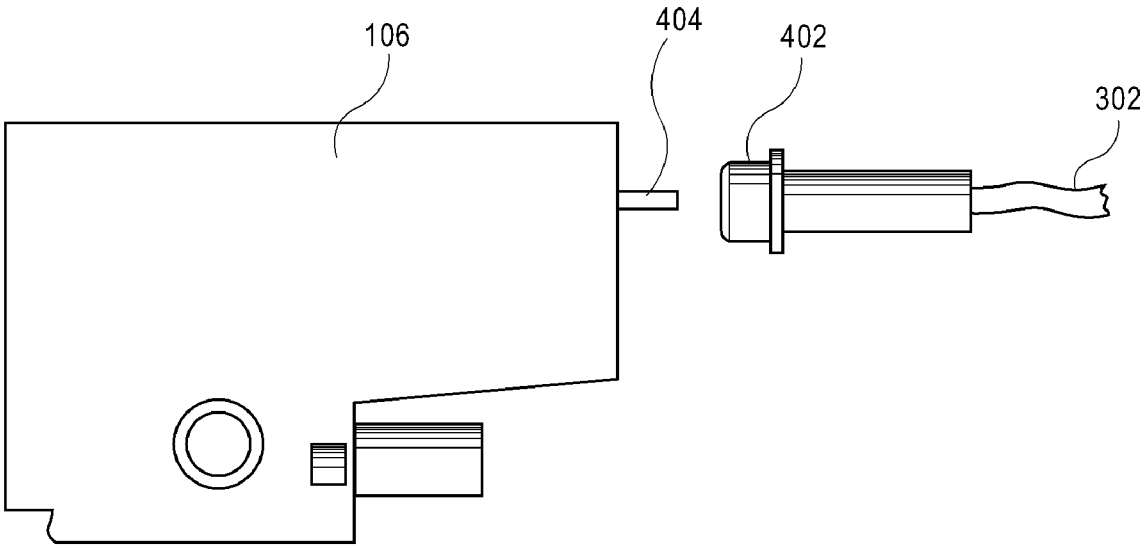
FIG. 4 is a diagram depicting how a print cartridge can be fluidically coupled to an internal colorant supply of a printing device, according to an embodiment of the invention.

FIG. 4 shows how the print cartridge 106 can be fluidically connected to the internal colorant supply 102 of the printing device 100 of FIG. 3, according to an embodiment of the invention. The tubing 302 originating from the internal colorant supply 102 is terminated at the mechanism 104 by a septum 402, where the supply 102 and the mechanism 104 are not particularly depicted in FIG. 4. By comparison, the print cartridge 106 includes a hollow needle 404. Removable insertion of the print cartridge 106 into the printing device 100 results in the hollow needle 404 piercing the septum 402 to fluidically connect or couple the print cartridge 106 with the internal colorant supply 102 via the tubing 302.

FIG. 5 shows a portion of the print cartridge 106 of FIG. 4 in more detail, according to an embodiment of the invention. The print cartridge 106 includes an absorptive interface 502, such as an absorptive material like a rigid sintered plastic filter, a bonded polyester fiber filter, and/or another type of capillary material or other material, that at least substantially surrounds the septum 402 upon removable insertion of the cartridge 106 into the mechanism 104 of the printing device 100. The absorptive interface 502 absorbs any colorant escaping from the septum 402, such as outside of the hollow needle 404 of the print cartridge 106. In one embodiment, the absorptive interface 502 itself, where rigid, may provide the fluidic connection with the colorant supply 102, without having to include a septum and needle.

FIG. 6 shows how, by comparison, the print cartridge 108 is not fluidically connected to the internal colorant supply 102 of the printing device 100 of FIG. 3, according to an embodiment of the invention. As in FIG. 4, the tubing 302 originating from the internal colorant supply 102 is terminated at the mechanism 104 by the septum 402, where the supply 102 and the mechanism 104 are not particularly depicted in FIG. 6. Unlike the print cartridge 106 of FIG. 4, the print cartridge 108 of FIG. 6 lacks a hollow needle within the area 602 corresponding to where the print cartridge 106 of FIG. 4 includes the hollow needle 404. As such, removable insertion of the print cartridge 108 into the printing device 100 results in the septum 402 remaining unpierced, and the colorant supply 102 fluidically uncoupled from the print cartridge 108. It is noted, however, that the print cartridge 108 of FIG. 6 may nevertheless include an absorptive interface, like the absorptive interface 502 of FIG. 5 that has been described in relation to the print cartridge 106 of FIG. 4.

Figure 7:
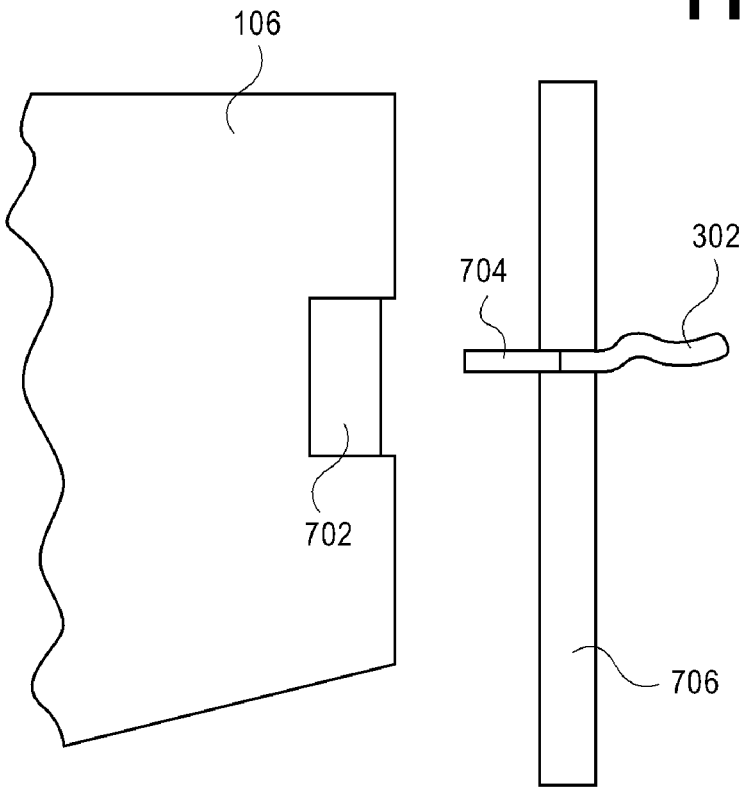
FIG. 7 is a diagram depicting how a print cartridge can be fluidically coupled to an internal colorant supply of a printing device, according to another embodiment of the invention.

FIG. 7 shows how the print cartridge 106 can be fluidically connected to the internal colorant supply 102 of the printing device 100 of FIG. 3, according to another embodiment of the invention. The tubing 302 originating from the internal colorant supply 102 is terminated at a manifold 706 of the mechanism 104 by a needle 704, where the supply 102 and other parts of the mechanism 104 are not particularly depicted in FIG.7. By comparison, the print cartridge 106 includes a septum 702. Removable insertion of the print cartridge 106 into the printing device 100 results in the hollow needle 704 piercing the septum 702 to fluidically connect or couple the print cartridge 106 with the internal colorant supply 102 via the tubing 302.

Figure 8:
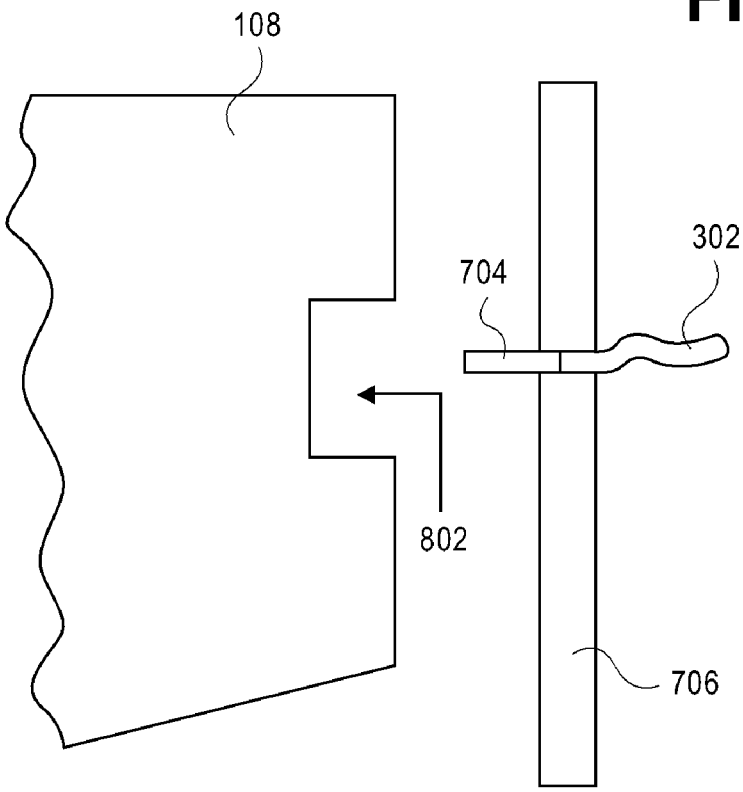
FIG. 8 is a diagram depicting how a print cartridge may not be fluidically coupled to an internal colorant supply of a printing device that is capable of fluidic coupling to a different type of print cartridge, according to an embodiment of the invention.

FIG. 8 shows how, by comparison, the print cartridge 108 is not fluidically connected to the internal colorant supply 102 of the printing device 100 of FIG. 3, according to another embodiment of the invention. As in FIG. 7, the tubing 302 originating from the internal colorant supply 102 is terminated at the manifold 706 of the mechanism 104 by the needle 704, where the supply 102 and other parts of the mechanism 104 are not particularly depicted in FIG. 8. Unlike the print cartridge 106 of FIG. 7, the print cartridge 108 of FIG. 8 lacks a septum within its corresponding interface region 802. Removable insertion of the print cartridge 108 into the printing device 100 results in the needle 704 mating with or being inserted into this interface region 802. Because the interface region 802 does not include a septum, the colorant supply 102 remains fluidically uncoupled from the print cartridge 108.

Embodiments of the invention have been described herein in which a printing device is receptive to removable insertion of one type of print cartridge that becomes fluidically coupled to an internal colorant supply of the device, and another type of print cartridge that remains fluidically uncoupled from the internal colorant supply. Those of ordinary skill within the art can appreciate that various permutations, adaptations, and variations can be made to these embodiments without departing from the scope of the invention as claimed. The print cartridges may have various keying features, for instance, to ensure that they are fluidically coupled to correspondingly colored supplies of internal colorant within the printing device. As another example, backpressure-regulating functionality and push-priming functionality, which may ensure proper operation of inkjet-printing devices in particular, may be provided within the print cartridges themselves, or within the printing device apart from the print cartridges, as can be appreciated by those of ordinary skill within the art.

We claim:

1. A printing device comprising:

a supply of colorant independent of any print cartridge insertable into the printing device; and, a mechanism receptive to removable insertion of a first print cartridge and a second print cartridge, where either one of the first print cartridge and the second print cartridge can be inserted into the mechanism at any given time;

wherein the first print cartridge at least ultimately uses the supply of colorant of the printing device to form the images on the media, wherein the second print cartridge has a self-contained supply of colorant that is exclusively used in lieu of the supply of colorant of the printing device to form the images on the media even though the supply of colorant independent of any print cartridge insertable into the printing device is present, and wherein the printing device is adapted to form the images on the media using the supply of colorant independent of any print cartridge insertable into the printing device when the first print cartridge is inserted into the mechanism and to form the images on the media using the self-contained supply of colorant contained within the second print cartridge when the second print cartridge is inserted into the mechanism.

2. The printing device of claim 1, wherein each of the first and the second print cartridges has a printhead by which the printing device forms images on media.

3. The printing device of claim 1, wherein the first print cartridge has a self-contained supply of colorant that is used to form the images on the media and that is replenished by the supply of colorant of the printing device as the images are formed on the media.

4. The printing device of claim 1, wherein the first print cartridge lacks a self-contained supply of colorant.

5. The printing device of claim 1, further comprising:

tubing fluidically coupling the supply of colorant to the mechanism; and, a septum terminating the tubing at the mechanism.

6. The printing device of claim 5, wherein the first print cartridge has a hollow needle that upon removable insertion of the first print cartridge into the mechanism pierces the septum to fluidically couple the first print cartridge to the supply of colorant.

7. The printing device of claim 6, wherein the first print cartridge has an absorptive interface that at least substantially surrounds the septum upon removable insertion of the first print cartridge into the mechanism, the absorptive interface to absorb any colorant escaping from the septum outside of the hollow needle.

8. The printing device of claim 6, wherein the second print cartridge lacks a hollow needle, such that upon removable insertion of the second print cartridge into the mechanism the septum remains unpierced and the supply of colorant remains fluidically uncoupled from second print cartridge.

9. The printing device of claim 8, wherein the second print cartridge has an absorptive interface that at least substantially surrounds the septum upon removable insertion of the second print cartridge into the mechanism, the absorptive interface to absorb any colorant escaping from the septum.

10. The printing device of claim 1, further comprising:

tubing fluidically coupling the supply of colorant to the mechanism; and, a hollow needle terminating the tubing at the mechanism.

11. The printing device of claim 10, wherein the first print cartridge has a septum that upon removable insertion of the first print cartridge into the mechanism is pierced by the needle to fluidically couple the first print cartridge to the supply of colorant.

12. The printing device of claim 10, wherein the second print cartridge has an interface that upon removable insertion of the second print cartridge into the mechanism does not fluidically couple the second print cartridge to the supply of colorant of the printing device.

13. The printing device of claim 1, wherein the supply of colorant of the printing device is at least substantially non-refillable.

14. The printing device of claim 1, wherein the supply of colorant comprises a bag of ink disposed within the printing device external to the first and the second print cartridges.

15. The printing device of claim 1, wherein the mechanism comprises a carriage to move across the media.

16. A printing device comprising:

a supply of colorant independent of any print cartridge insertable into the printing device; and, means for receiving a first print cartridge or a second print cartridge, each of the first and the second print cartridges having a printhead by which the printing device forms images on media, wherein the first print cartridge at least ultimately uses the supply of colorant of the printing device to form the images on the media, wherein the second print cartridge has a self-contained supply of colorant that is exclusively used in lieu of the supply of colorant of the printing device to form the images on the media even though the supply of colorant independent of any print cartridge insertable into the printing device is present, and wherein the printing device is adapted to form the images on the media using the supply of colorant independent of any print cartridge insertable into the printing device when the first print cartridge is inserted into the mechanism and to form the images on the media using the self-contained supply of colorant contained within the second print cartridge when the second print cartridge is inserted into the mechanism.

17. The printing device of claim 16, wherein the first print cartridge has a self-contained supply of colorant that is used to form the images on the media and that is replenished by the supply of colorant of the printing device as the images are formed on the media.

18. A method comprising:

inserting a first print cartridge into a corresponding mechanism of the printing device, the first print cartridge having a printhead and that is fluidically coupled to a supply of colorant of the printing device external to the first print cartridge;

forming images on media using the first print cartridge until the supply of colorant of the printing device is at least substantially exhausted;

removing the first print cartridge from the printing device;

inserting a second print cartridge into the corresponding mechanism of the printing device, the second print cartridge having a printhead and a self-contained supply of colorant; and, forming images on media using the second print cartridge until the self-contained supply of colorant within the second print cartridge is at least substantially exhausted.

19. The method of claim 18, further comprising:

removing the second print cartridge from the printing device;

inserting another second print cartridge into the corresponding mechanism of the printing device, the other second print cartridge having a printhead and a self-contained supply of colorant; and, forming images on media using the second print cartridge until the self-contained supply of colorant within the second print cartridge is at least substantially exhausted.

20. The method of claim 18, wherein the first print cartridge has a self-contained supply of colorant, the method further comprising replenishing the self-contained supply of colorant within the first print cartridge with colorant from the supply of colorant of the printing device as the images are formed on the media.

* * * * *

UNITED STATES PATENT AND TRADEMARK OFFICE

CERTIFICATE OF CORRECTION

PATENT NO. : 7,950,788 B2
APPLICATION NO. : 11/738322
DATED : May 31, 2011
INVENTOR(S) : Patrick Therien et al.

It is certified that error appears in the above-identified patent and that said Letters Patent is hereby corrected as shown below:

In column 7, line 39, in Claim 1, delete “mechanism” and insert -- mechanism, --, therefor.

In column 8, line 53, in Claim 16, delete “mechanism” and insert -- mechanism, --, therefor.

Signed and Sealed this
Third Day of April, 2012

David J. Kappos

David J. Kappos
*Director of the United States Patent and Trademark Office*